United States Patent [19]

Barley

[11] Patent Number: 4,632,345

[45] Date of Patent: Dec. 30, 1986

[54] COLLAPSABLE TABLE AND SUPPORT TABLE

[76] Inventor: Keith A. Barley, 806 E. Oklahoma, Ponca City, Okla. 74601

[21] Appl. No.: 780,850

[22] Filed: Sep. 27, 1985

[51] Int. Cl.[4] ..... F16M 11/00

[52] U.S. Cl. ..... 248/174; 108/111; 248/676; 312/259

[58] Field of Search ..... 248/174, 676, 459, 152; 312/258, 259; 108/111; 211/72, 73

[56] References Cited

U.S. PATENT DOCUMENTS

| | | | |
|---|---|---|---|
| 2,031,477 | 2/1936 | Gianninoto et al. | 248/459 |
| 2,121,190 | 6/1938 | Fellowes | 312/108 |
| 2,390,546 | 12/1945 | Mather | 248/174 X |
| 2,550,959 | 5/1951 | Bowman | 312/258 X |
| 2,876,114 | 3/1959 | Robertson et al. | 248/174 X |
| 3,031,125 | 4/1962 | Felton | 312/108 |
| 3,784,083 | 1/1974 | Pfaffendorf et al. | 312/259 R |
| 3,837,719 | 9/1974 | Barron | 312/195 |
| 4,231,299 | 11/1980 | Gebhardt et al. | 108/111 X |
| 4,523,675 | 6/1985 | Schroter | 248/174 X |

*Primary Examiner*—J. Franklin Foss
*Assistant Examiner*—David L. Talbott

[57] ABSTRACT

A collapsable table for the support of a heavy object is formed from a reinforced rectangularly shaped center panel with reinforced side supports. The supports are folded 90 degrees to the center panel and a retaining panel is bent and locked into the support panels to provide a rigid structure. Slots are formed in the center panel in a position to accommodate paper and the like. A support table is formed for the collapsable table and adapted for receiving the collapsable table.

5 Claims, 5 Drawing Figures

COLLAPSABLE TABLE AND SUPPORT TABLE

BRIEF DESCRIPTION OF THE PRIOR ART

The best prior art known to Applicant are U.S. Pat. No. 2,121,190 issued to H. L. Fellowes, U.S. Pat. No. 3,031,125 to D. L. Felton and U.S. Pat. No. 3,837,719 to Abraham Barron.

U.S. Pat. No. 2,121,190 to H. L. Fellowes discloses a COLLAPSABLE filing cabinet of the drawer type which is fabricated largely of paper board and which when its parts are erected is a strong and easily manipulated. The Patent discloses a substantially all cardboard structure pinned together with steel reinforcing.

U.S. Pat. No. 3,031,125 to D. L. Felton also relates to a COLLAPSABLE file cabinet used for a storage file which is made of substantially cardboard. It is also pinned together and has metal reinforcing.

U.S. Pat. No. 3,837,719 to Abraham Barron relates to a COLLAPSABLE desk and chair and discloses a desk made from a cardboard structure prefabricated and designed to be collapsed. It is essentially formed of three parts, a left support, a right support and a center table support interconnecting the left and right supports. While it discloses a table, once the various portions are assembled, the overall structure is extremely complex to assemble, fairly large and even when collapsed requires a substantial storage space.

BRIEF DESCRIPTION OF THE INVENTION

This invention basically describes a COLLAPSABLE table made from a single sheet of cardboard useful for supporting a heavy apparatus such as a computer controlled printer. It is formed by making a reinforced top of a rectangular shaped center panel with an end panel folded along a first edge of the center panel and against the center panel thereby forming a double thickness top. Side supports which are reinforced are formed of a side panel with a second panel folded against the inner surface of the side panel with a slot and tab to lock the folded reinforcing panel against the support. The support are then folded 90 degrees to the center panel and a panel is then formed on the remaining edge of the center panel and dimensioned to be folded between the support panels with locking tabs on opposite sides of the positioning panel so that the side panels are firmly and rigidly locked into a 90 degree position with respect to the center panel.

Slots are formed in the center panel in a position to accommodate paper moving from either underneath the printer or in the back of the printer.

A support table which can be formed of a second sheet of cardboard is formed of a center panel having oppositely extending support panels which can be folded 90 degrees to the center panel. Each of the support panels is provided with additional panels that can be folded along the support panels and locked into a slot formed on opposite edges of the center panel. Tabs on the folded portions of the support panel are inserted into the slots, thereby forming a rigid table. Additional slots are provided in the top of the table center panel to accommodate the assembled print table.

DETAILED DESCRIPTION OF THE INVENTION

Figure 1:
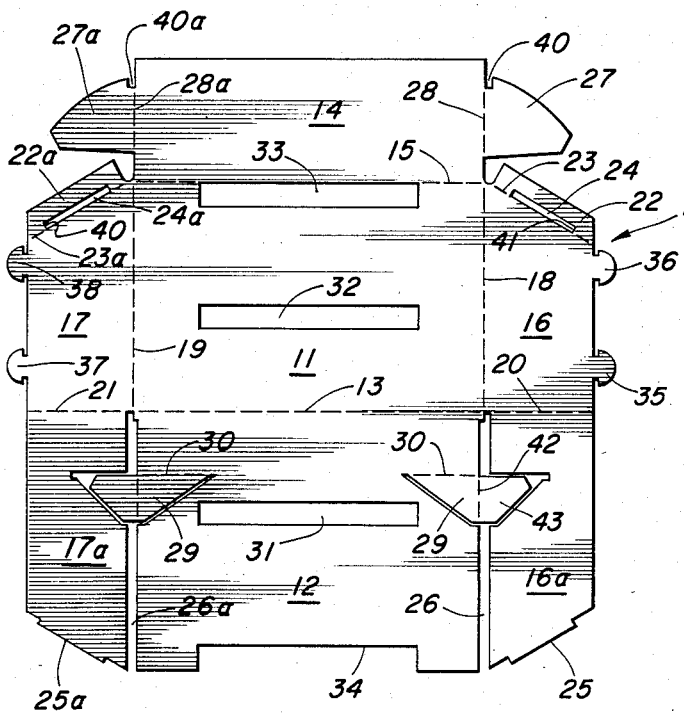
FIG. 1 is a illustration of the print table as it would be cut out of the blank paperboard.
Figure 3:
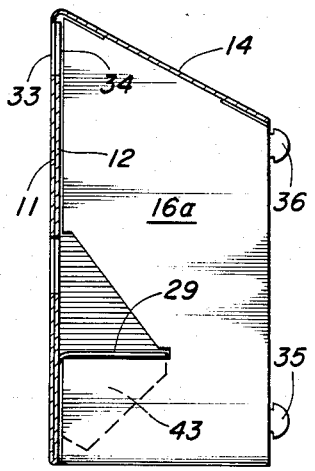
FIG. 3 is a cross-section 3—3 taken through FIG. 2.
Figure 2:
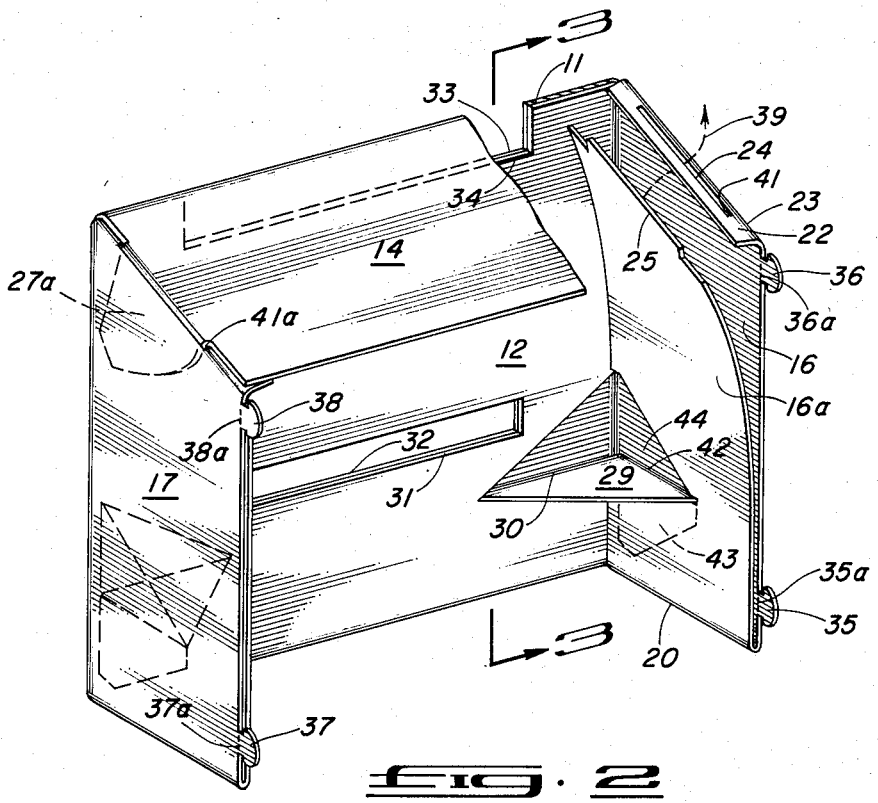
FIG. 2 is a perspective view of the print table assembled showing the various reinforcing layers.

Referring to all of the drawings, but specifically to FIGS. 1 through 3, the COLLAPSABLE rigid print table is illustrated. The print table is cut out of a single sheet of reinforced paper such as cardboard. The reinforced paper may have a design on one side that will make the table appear, for example, as having a wood grain or other designs can be printed on the table if desired so that when it is assembled it will have a more pleasing appearance.

Referring specifically to FIG. 1, a print table 10 is formed from a single sheet of cardboard. The cut out portion generally includes a center panel 11, a first end panel 12, having a fold line 13 along one edge of center panel 11. A second end panel 14 is attached to center panel 11 along a fold line 15. Two side panels 16 and 17 are attached to center panel 11 along each edge as fold lines 18 and 19, respectively. Each side panel 16 and 17 has a reinforcing side panel **16*a* and 17*a*. Reinforcing side panel 16*a* and reinforcing side panel 17*a* are attached respectively to side panels 16 and 17 along fold lines 20 and 21 respectively. Opposite fold line 20 on side panel 16 is a locking tab 22 having a fold line 23 and slot 24 therein. Side panel 17, likewise, has a locking tab 22*a*, a fold line 23*a* and a slot 24*a*. A mating tab 25 and 25*a* are attached to the reinforcing side panels 16*a* and 17*a*, respectively. Slots 26 and 26*a* provide freedom of movement for reinforcing side panels 16*a* and 17*a*, respectively. Locking tabs 27 and 27*a* are attached to the opposite edges along fold lines 28 and 28*a***, respectively.

Stabilizing angle portions are formed by cutting a portion from the first end panel and the reinforcing side panels **16*a* and 17*a*. The stabilizing angle portion 29 are each attached along a fold line 30 to the first end panel 12. The tab is free to move by cutting the remainder of stabilizing angle portion 29 from the surrounding paperboard. Suitable slots 31, 32, 33 and cut out portion 34 are provided for forming an access from under the table, when assembled, to the printer which will be supported on top of table 10. Slots 31 through 34 may be perforated for optional removal. Tabs 35, 36, 37 and 38 are attached to side panels 16 and 17 respectively for future attachment, if desired, of the assembled table on a support table which will be described with reference to FIGS. 4 and 5. If it is not desired to use the support table, tabs 35 through 38 can be cut off or folded under table 10**.

ASSEMBLY

The apparatus described in FIGS. 1 through 3 is assembled as follows:

Referring particularly to FIGS. 1 and 2, first end panel 12 is folded along fold line 13 against center panel 11 so that slots 31 and 32 are aligned and cut out 34 and slot 33 are aligned. The alignment of these slots are fully illustrated in FIG. 2. The center panel and the first end panel when as assembled in FIG. 2, form a extremely substantial support for any heavy object such as a computer controlled printer. The side supports are then formed by folding panel 16*a* against panel 16 along fold line 20 and panel 17*a* against panel 17 along fold line 21. Tabs 22 and 22*a* are then folded 90 degrees to side panel 16 and tab 25 is forced into slot 24 as illustrated by dotted line 39 in FIG. 2. Second end panel 14 is folded against the 90 degree folded tabs 22 and 22*a* and tabs 27 and 27*a* are folded along fold lines 28 and 28*a*, 90 degrees and inserted into slots 24 and 24*a*, respectively. Tabs 27 and 27*a* are preferably inserted between 16 and 16*a* and 17 and 17*a*, respectfully, for more rigid construction are better appearance. The tabs will then be pushed until second end panel 14 is flush against 90 degree folded tabs 22 and 22*a* at which time a notch 40 and 40*a* will lock into the end 41 and 41*a* of slot 24 and 24*a*, respectively.

In order to further support side panels 16 and 17, a triangular stabilizing portion 29 is folded along a fold line 42 so that a tab portion 43 can enter the cut out portion 44 formed between reinforced side panel 16*a* and side panel 16 in the manner illustrated in FIG. 2. The other triangular portion of 29 is likewise inserted similar to the previously described triangular portion 19 between reinforced side panel 17*a* and side panel 17. The print table is now assembled and firmly anchored so that it can not move either sideways, forward, backwards or in any manner that will cause it to collapse under a heavy weight.

Tabs 35 through 38 can either be used for anchoring the print table 10 to a subsequent support table or they can be removed by tearing along tear lines 35*a* through 38*a* which are perforated for the convenience of removal.

SUPPORT TABLE

Figure 4:
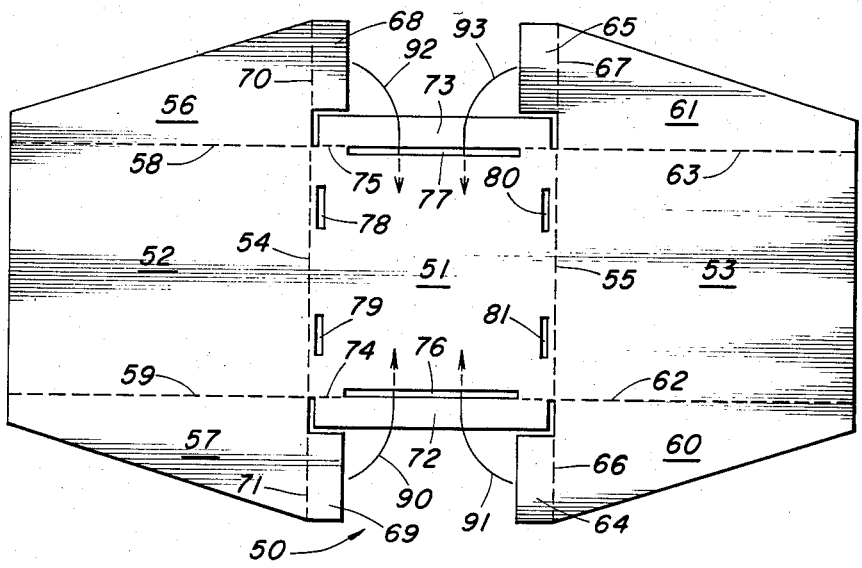
FIG. 4 is the supporting table cut of a blank piece of paperboard.
Figure 5:
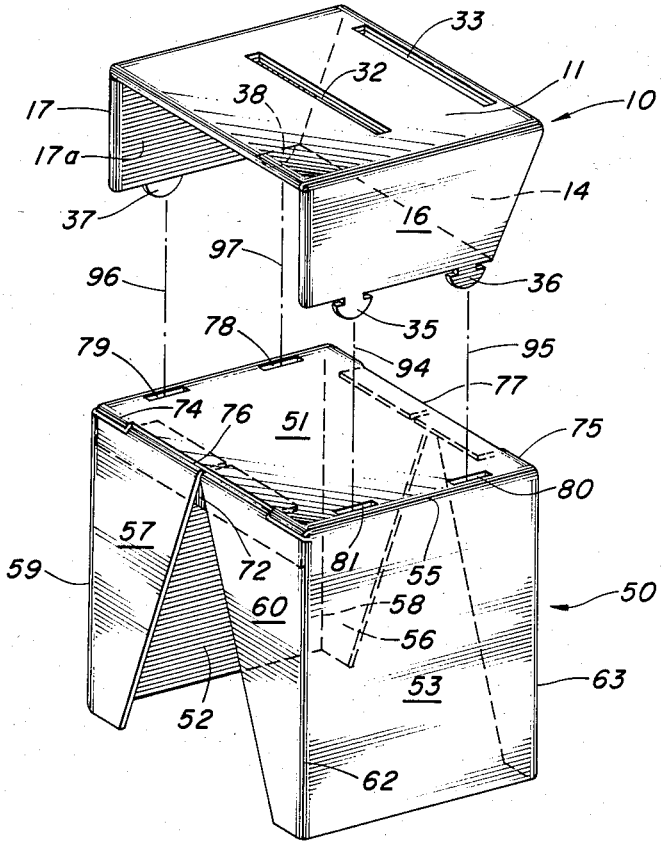
FIG. 5 is the assembled version of the table illustrated in FIG. 4 and also illustrating the assembly of the print table shown in FIGS. 1 through 3 and the manner of assembling same to the support table.

A support table for printer table 10 is illustrated in FIGS. 4 and 5. Here support table 10 is formed from a single cardboard or paperboard blank and generally referred to by number 50 and has a center panel 51 with a first end panel 52 and a second end panel 53 attached thereto along fold lines 54 and 55, respectively. Side panel 52 has reinforcing panels 56 and 57 which are attached to opposite edges of side panel 52 along fold lines 58 and 59, respectively. Side panel 53 has reinforcing side panels 60 and 61 attached to opposite sides of side panel 53 along fold lines 62 and 63, respectively. Reinforcing side panels 60 and 61 each have locking tabs 64 and 65 attached thereto along fold lines 66 and 67, respectively. Reinforcing side panels 56 and 57 have similar tabs 68 and 69 which are attached to reinforcing side panels 56 and 57 along fold lines 70 and 71, respectively.

Center panel 51 has support tabs 72 and 73 attached to opposite edges along fold lines 74 and 75, respectively, with slots 76 and 77 formed along fold lines 74 and 75, respectively. Also, along fold line 54 are slots 78 and 79 and along fold lines 55 are slots 80 and 81.

The assembly of FIG. 4 is as follows: tabs 72 are bent downwardly 90 degrees to the facing surface of center panel 51. The first and second end panels 52 and 53 are then bent downwardly 90 degrees to the surface of center panel 51 in the manner illustrated in FIG. 5. Panels 60 and 61 are then bent 90 degrees inwardly along fold lines 62 and 63 to panel 53 and reinforcing end panel 56 and 57 are bent inwardly to end panel 52 along fold lines 58 and 59 as illustrated in FIG. 5.

In order to lock the structure together as an unitary structure, tabs 64 and 69 are then bent 90 degrees downwardly in the assembled position shown in FIG. 5, along fold lines 66 and 71, respectively, and then inserted along the direction of arrows 90 and 91 into slot 76. Since the width of tab 69 and 64 are exactly the same as the length of slot 76 the tabs will anchor once they are inserted into slot 76. Tabs 65 and 68 are bent in a similar manner and inserted along arrows 92 and 93 into slot 77 so that they will lock the reinforcing side panels 56 and 61 rigidly into position illustrated in FIG. 5. Once the tabs 64, 69, 65 and 68 have been locked into slots 76 and 77, respectively, the support table is complete.

In order to assemble print table 10 onto support table 50, tab 35, 36, 37 and 38 are assembled along dotted lines 94, 95, 96 and 97 into slots 81, 80, 79 and 78 respectively in support table 50. As then assembled, the print table 10 and the support table 50 will become one unitary structure.

CONCLUSIONS

It can be seen from the aforementioned that from a simple single piece of cardboard, an extremely rigid table is constructed that will support an extremely heavy weight such as a computer operated printer and the like. Appropriate slots are placed in the table to provide for paper feed from under the table to the printer and removable tabs are provided to assemble the table onto a support table if desire. Further, a support table is illustrated which clearly provides for a means of supporting the print table 10 at table height, if desire.

The support table is likewise constructed of a single piece of cardboard or paperboard and easily folded into an extremely rigid structure for supporting a heavy weight which will be placed upon the assembled print table and support table.

It is obvious that modifications and changes can be made in the particular arrangements of the folds and slots or tabs and still be well within the spirit and scope of this invention as described in the specifications and appended claims.

What I claim is:

1. A collapsable table for supporting a heavy apparatus comprising (a) a reinforced top formed of a rectangularly shaped center panel means with an end panel means folded along a first edge of said center panel means against said center panel means thereby forming a double thickness panel;

(b) first and second reinforced support means each formed of a side panel means with a second side panel folded against the inner surface of said side panel means including means to secure said second side panel, each of said first and second reinforced support means attached along support fold lines along the second and third edge of said center panel means; so that each of said reinforced support means can be folded to a position substantially perpendicular to said center panel means;

(c) positioning means attached to the remaining edge of said center panel means for rigidly posititioning said first and second reinforced support means in said substantially perpendicular position by folding said positioning means along said remaining edge into engagement with said first and second reinforced support means; and (d) means for locking said positioning means to each of said first and second reinforced support means whereby said first and second reinforced support means will be rigidly secured in substantially perpendicular relationship to said center panel means.

2. Apparatus as described in claim 1 wherein said means for locking said positioning means comprises a tab folded at right angles alaong a fold line at the end of each of said side panel means, with a locking slot in said fold line and a tab formed at the end of each of said second side panels for insertion into said locking slot.

3. Apparatus as described in claim 2 wherein said means for locking said positioning means comprises tabs formed on opposite edges of said positioning means adjacent its attached edge, said tabs adapted for insertion into each of said locking slots.

4. Apparatus as described in claim 1 including a support table comprising (a) a center panel of substantially rectangular shape;

(b) support side panel means attached alaong opposite edges of said center panel, said attachment forming a fold line;

(c) tab means attaching to the remaining opposite edge of said center panel said attachment forming a fold line;

(d) slot means formed through said tab means along said fold line;

(e) first and second stiffening panel means attached along opposite side of each of said support side panel means, said first and second stiffening panel means each having locking tab means positioned for insertion through said slot means;

(f) a plurality of tabs attached to said collapsable table, first and second reinforced support means which are adapted to mate with a plurality of slot means in said center panel of said support table to rigidly secure said collapsable table to said support table whereby when said support side panel means are bent perpendicular to said center panel along said fold line and said stiffening panel means are bent perpendicular to said support side panel means in a manner to engage each of said tab means with its cooperating slot means a support table is formed for receiving said collapsable table.

5. A support table comprising (a) a center panel of substantially rectangular shape;

(b) support side panel means attached along opposite edges of said center panel, said attachment forming a fold line;

(c) tab means attaching to the remaining opposite edge of said center panel said attachment forming a fold line;

(d) slot means formed through said tab means along said fold line;

(e) first and second stiffening panel means attached along opposite side of each of said support side panel means, said first and second stiffening panel means each having locking tab means positioned for insertion through said slot means;

whereby when said support side panel means are bent perpendicular to said center panel along said fold line and said stiffening panel means are bent perpendicular to said support side panel means in a manner to engage each of said tab means with its cooperating slot means a support table is formed.

* * * * *